US006588200B1

(12) United States Patent
Surnilla et al.

(10) Patent No.: US 6,588,200 B1
(45) Date of Patent: Jul. 8, 2003

(54) METHOD FOR CORRECTING AN EXHAUST GAS OXYGEN SENSOR

(75) Inventors: Gopichandra Surnilla, West Bloomfield, MI (US); Grant Alan Ingram, West Lafayette, IN (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 09/783,351

(22) Filed: Feb. 14, 2001

(51) Int. Cl.[7] ..... F01N 3/00
(52) U.S. Cl. ..... 60/276; 60/274; 60/285
(58) Field of Search ..... 60/274, 285, 276; 73/23.31, 23.32

(56) References Cited

U.S. PATENT DOCUMENTS

| | | | | |
|---|---|---|---|---|
| 3,886,260 A | * | 5/1975 | Unland | 60/301 |
| 4,707,984 A | * | 11/1987 | Katsuno et al. | 60/274 |
| 5,115,639 A | | 5/1992 | Gopp | |
| 5,282,360 A | | 2/1994 | Hamburg et al. | |
| 5,343,701 A | * | 9/1994 | Douta et al. | 60/276 |
| 5,473,887 A | | 12/1995 | Takeshima et al. | 60/276 |
| 5,528,899 A | * | 6/1996 | Ono | 60/285 |
| 5,537,816 A | | 7/1996 | Ridgway et al. | |
| 5,579,637 A | * | 12/1996 | Yamashita et al. | 60/276 |
| 5,610,321 A | * | 3/1997 | Shinmoto | 60/277 |
| 5,619,852 A | * | 4/1997 | Uchikawa | 60/276 |
| 5,655,363 A | * | 8/1997 | Ito et al. | 60/276 |
| 5,771,685 A | | 6/1998 | Hepburn | 60/274 |
| 5,877,413 A | | 3/1999 | Hamburg et al. | |
| 5,894,725 A | | 4/1999 | Cullen et al. | 60/274 |
| 5,970,707 A | | 10/1999 | Sawada et al. | 60/277 |
| 5,983,629 A | * | 11/1999 | Sawada | 60/276 |
| 6,138,453 A | | 10/2000 | Sawada et al. | 60/277 |
| 6,145,305 A | | 11/2000 | Itou et al. | 60/277 |
| 6,220,017 B1 | * | 4/2001 | Tayama et al. | 60/277 |
| 6,345,498 B2 | | 2/2002 | Yonekura et al. | 60/277 |

FOREIGN PATENT DOCUMENTS

JP 09-126012 * 5/1997

OTHER PUBLICATIONS

Co–Pending patent application Ser. No. 10/016,942 filed Dec. 14, 2001, Entitled "Lean $NO_x$ Storage Estimation Based On Oxygen Concentration Corrected For Water Gas Shift Reaction".

* cited by examiner

*Primary Examiner*—Thomas Denion
*Assistant Examiner*—Diem Tran
(74) *Attorney, Agent, or Firm*—Julia Voutyras; Allan J. Lippa

(57) ABSTRACT

An engine air/fuel controller is responsive to an exhaust gas oxygen sensor positioned upstream of a catalytic converter and a proportional exhaust gas oxygen sensor positioned downstream of the catalytic converter. An air/fuel ratio signal provided by the downstream exhaust gas oxygen sensor is adjusted by a correction bias value. A first preferred method of deriving the correction bias value includes calculating the difference between the average of the upstream and downstream air/fuel ratios when the upstream sensor indicates lean operation of the engine. The second preferred method includes deriving the correction bias according a pre-determined and pre-programmed correction bias function, which provides correction bias values as a function of the of the air/fuel ratio measured by the downstream sensor.

22 Claims, 4 Drawing Sheets

METHOD FOR CORRECTING AN EXHAUST GAS OXYGEN SENSOR

FIELD OF THE INVENTION

The field of the invention relates to an air/fuel control system of an internal combustion engine coupled to a catalytic converter. In particular, the invention relates to adjusting the air/fuel ratio measurement of a post-catalyst proportional exhaust gas oxygen sensor to correct for the water gas shift reaction that occurs in the catalytic converter of the vehicle's exhaust system.

BACKGROUND OF THE INVENTION

To minimize undesirable emissions from an automotive vehicle, it is known to control the air/fuel (A/F) ratio supplied to the vehicle engine within a relatively narrow range around the stoichiometric ratio. Various specific methods are known to control the engine air/fuel ratio within this so-called conversion window. Some of these methods include calculating desired air/fuel ratios at various times based upon feedback signals from exhaust gas oxygen (EGO) sensors positioned both upstream and downstream of the vehicle's catalyst. An example of such an approach is disclosed in U.S. Pat. No. 5,115,639. Furthermore, systems that include both upstream and downstream EGO sensors commonly employ the output signals of those sensors to perform other diagnostic and control functions, such as estimating oxygen storage in the vehicle's catalyst(s), estimating catalyst sulfation, estimating catalyst degradation, and the like.

To achieve optimal air/fuel control and accurate operation of the various other diagnostic and control functions described above, it is important that the EGO sensors provide accurate measurements. This is particularly true when the post-catalyst sensor is a proportional exhaust gas oxygen sensor, such as a conventional universal exhaust gas oxygen (UEGO) sensor, which provides an output signal indicative of the actual measured air/fuel ratio (as opposed to a two-state EGO sensor that only provides an indication that the air/fuel ratio is either rich or lean). However, the inventors hereof have recognized that a post-catalyst proportional UEGO sensor may systematically provide somewhat inaccurate measurements as a result of a water gas shift reaction that occurs inside of the vehicle's exhaust stream between the pre-catalyst and post-catalyst sensors. Specifically, during steady-state operation (either rich or lean), the air/fuel ratio measured by the post-catalyst UEGO sensor should be substantially identical to the air/fuel ratio upstream of the catalyst. But the inventors hereof have recognized that the output of the post-catalyst UEGO sensor tends to indicate an air/fuel ratio that is less lean during lean operation of the engine and less rich during rich operation relative to the air/fuel ratio upstream of the catalyst. This is a systematic error that the inventors have attributed to the water gas shift reaction that occurs in the vehicle's exhaust system. To achieve optimal air/fuel control and accurate results from the vehicle's various diagnostic and control systems, it is desirable to adjust the output signal of the post-catalyst UEGO sensor to correct for the water gas shift reaction. Accordingly, the inventors have recognized that there is a need for a method and system to correct the output of a post-catalyst exhaust oxygen sensor.

SUMMARY OF THE INVENTION

The present invention comprises a method and system for adjusting an air/fuel ratio signal from a post-catalyst proportional UEGO sensor to correct for the water gas shift reaction that occurs in the vehicle's exhaust stream between the pre-catalyst and post-catalyst sensors, particularly in the vehicle's catalytic converter. The invention includes adjusting the output signal received from the post-catalyst UEGO sensor by adding a correction bias, which is derived by one of two preferred methods. According to the first preferred method, the correction bias is derived for a particular lean or rich air/fuel excursion during normal operation of the vehicle based upon actual output signals of the pre-catalyst and post-catalyst sensors received during a previous lean or rich excursion. Specifically, the correction bias is derived by taking the difference between the respective averages of the pre-catalyst and post-catalyst air/fuel ratios during a period of lean engine operation. Then, during a subsequent lean operation of the engine, the correction bias is added to the output signal of the post-catalyst UEGO sensor to adjust toward a leaner air/fuel ratio output. A similar method may be applied to adjust the output of the post-catalyst UEGO sensor during rich operation of the engine.

A second preferred method of the present invention includes pre-programming a correction bias function that provides correction biases as a function of the non-corrected output of the post-catalyst sensor. The pre-programmed function can take various forms, such as a formula, look-up table, or map profile, and is used to determine correction biases for the post-catalyst sensor at any time based upon the non-corrected output of the post-catalyst sensor. As in the first preferred method, the correction bias is added to the output signal of the post-catalyst sensor to adjust toward a leaner air/fuel ratio during lean operation and toward a richer air/fuel ratio during rich operation of the engine.

Various objects and advantages of this invention will become apparent to those skilled in the art from the following detailed description of the preferred embodiment, when read in light of the accompanying drawings.

DETAILED DESCRIPTION OF PREFERRED EMBODIMENTS

Figure 1:
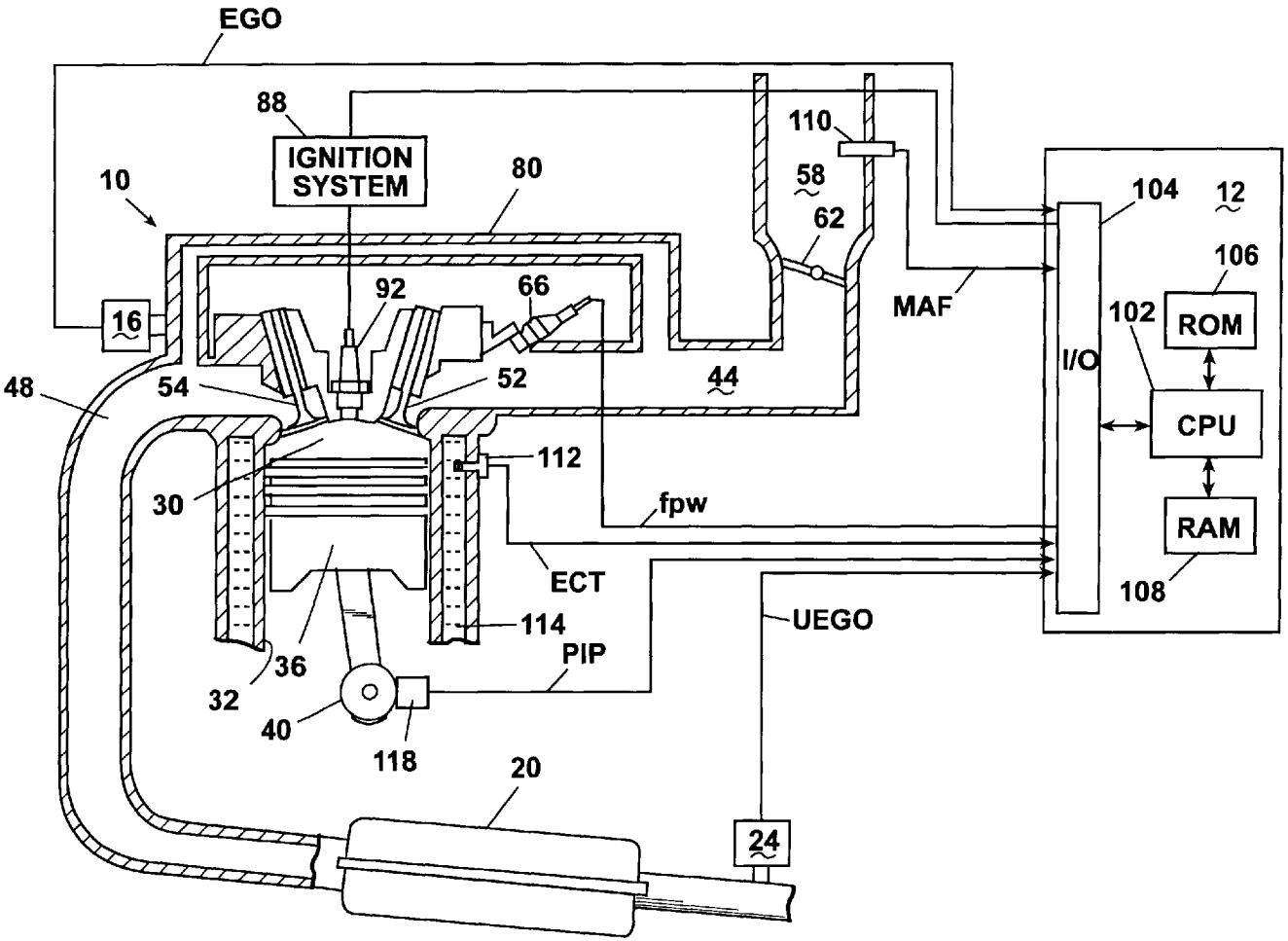
FIG. 1 is a schematic diagram of a representative internal combustion engine and UEGO sensor correction system, according to a preferred embodiment of the invention.

Referring to FIG. 1, internal combustion engine 10 comprises a plurality of cylinders (only one of which is shown in FIG. 1). Each cylinder of engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Intake manifold 44 is shown communicating with throttle body 58 via throttle plate 62. Intake manifold 44 is also shown having fuel injector 66 coupled thereto for delivering liquid fuel in proportion to the pulse width of signal FPW from controller 12. Fuel is delivered to fuel injector 66 by a conventional fuel system (not shown) including a fuel tank, fuel pump, and fuel rail (not shown).

Engine 10 is controlled by electronic engine controller 12 in response to feedback signals from pre-catalyst proportional exhaust gas oxygen (UEGO) sensor 16 and post-catalyst proportional exhaust gas oxygen (UEGO) sensor 24 (signals EGO and UEGO, respectively). UEGO sensors 16 and 24 are proportional UEGO sensors, such as conventional universal exhaust gas oxygen (UEGO) sensors, that provide output signals indicative of the actual detected air/fuel ratio. Generally, the air/fuel control system attempts to maintain the air/fuel ratio in the engine 10 within the conversion window of catalytic converter 20 based on the feedback signals from pre-catalyst sensor 16 and post-catalyst sensor 24.

Controller 12 is shown in FIG. 1 as a conventional microcomputer including: microprocessor unit 102, input/output ports 104, read only memory 106, random access memory 108, and a conventional data bus. Controller 12 is shown receiving various signals from sensors coupled to engine 10, in addition to those signals previously discussed, including: measurements of inducted mass air flow (MAF) from mass air flow sensor 110 coupled to throttle body 58; engine coolant temperature (ECT) from temperature sensor 112 coupled to cooling sleeve 114; and a profile ignition pickup signal (PIP) from Hall effect sensor 118 coupled to crankshaft 40. Conventional distributorless ignition system 88 provides ignition spark to combustion chamber 30 via spark plug 92 in response to controller 12.

The present invention generally includes correcting for the water gas shift reaction that occurs in the catalytic converter 20. The water gas shift reaction, which converts CO to $H_2$ in the vehicle's exhaust system, is given by:

$$CO+H_2O \rightarrow H_2+CO_2.$$

Thus, the vehicle exhaust gas has a lower concentration of CO and a higher concentration of $H_2$ downstream of the catalytic converter 20 than upstream. Because the output of conventional proportional UEGO sensors is sensitive to the concentrations of CO and $H_2$ in the exhaust gas, the output of the post-catalyst UEGO sensor 24 is affected by the water gas shift reaction that occurs in the catalytic converter 20. As a result, the output of post-catalyst UEGO sensor 24 (signal UEGO) tends to indicate a less lean air/fuel ratio during lean operation of the engine 10 and a less rich air/fuel ratio during rich operation relative to the air/fuel ratio upstream of the catalyst 20.

To correct for the systematic error resulting from the water gas shift reaction, the present invention adjusts the output of the post-catalyst sensor output by adding a correction bias to it. According to a first preferred method of the invention, a correction bias is estimated based upon the mathematical difference between respective average pre-catalyst and post-catalyst air/fuel ratios measured during a period of lean engine operation. Then, the calculated correction bias is used to adjust the post-catalyst sensor output during a subsequent period of lean operation. A similar method can be used to determine a correction bias during periods of rich engine operation. According to a second preferred method of the invention, a correction bias function is pre-determined and pre-programmed to provide a correction bias based upon a non-corrected post-catalyst air/fuel ratio measurement.

The first preferred method of the invention will now be described in more detail. It is typical for an air/fuel control system to alternatively operate the engine in a lean mode and then a rich mode for various periods of time. Further, it is also known to operate the engine with a lean air/fuel ratio for extended periods of time to maximize fuel efficiency. Accordingly, for purposes of illustration, the first preferred embodiment of the invention will be described with respect to determining and applying a lean correction bias, though it is also possibly to apply the present invention during rich operation of the engine. Controller 12 determines a lean correction bias to be used to adjust the post-catalyst sensor output during a subsequent period of lean operation based upon the average air/fuel ratio measurements during the current period of lean engine operation. Specifically, during the current period of steady-state lean engine operation, controller 12 calculates an average of the air/fuel ratio measurements received from pre-catalyst sensor 16 and an average of the air/fuel ratio measurements received from post-catalyst sensor 24. Controller 12 calculates a lean operation correction bias by subtracting the average post-catalyst air/fuel ratio from the average pre-catalyst air/fuel ratio. Then, during a subsequent period of lean engine operation, the controller 12 adds the previously-calculated lean correction bias to the output of the post-catalyst sensor 24. As mentioned above, a similar method can be used to calculate a rich correction bias that can be used to adjust the output of the post-catalyst sensor 24 during a subsequent period of rich engine operation.

According to a variation of the first embodiment of the invention, the pre-catalyst air/fuel ratio measurement can be replaced with the commanded air/fuel ratio, which the controller 12 causes to be provided to the engine. In other words, as an alternative to calculating the correction bias based upon the difference between measured pre-catalyst and post-catalyst air/fuel ratios, it is possible, and within the scope of this invention, to calculate the correction bias based upon the difference between the measured post-catalyst air/fuel ratio and the commanded air/fuel ratio provided to the engine. This variation on the first preferred embodiment of the invention is particularly useful in connection with a system that does not include a pre-catalyst sensor.

Figure 2:
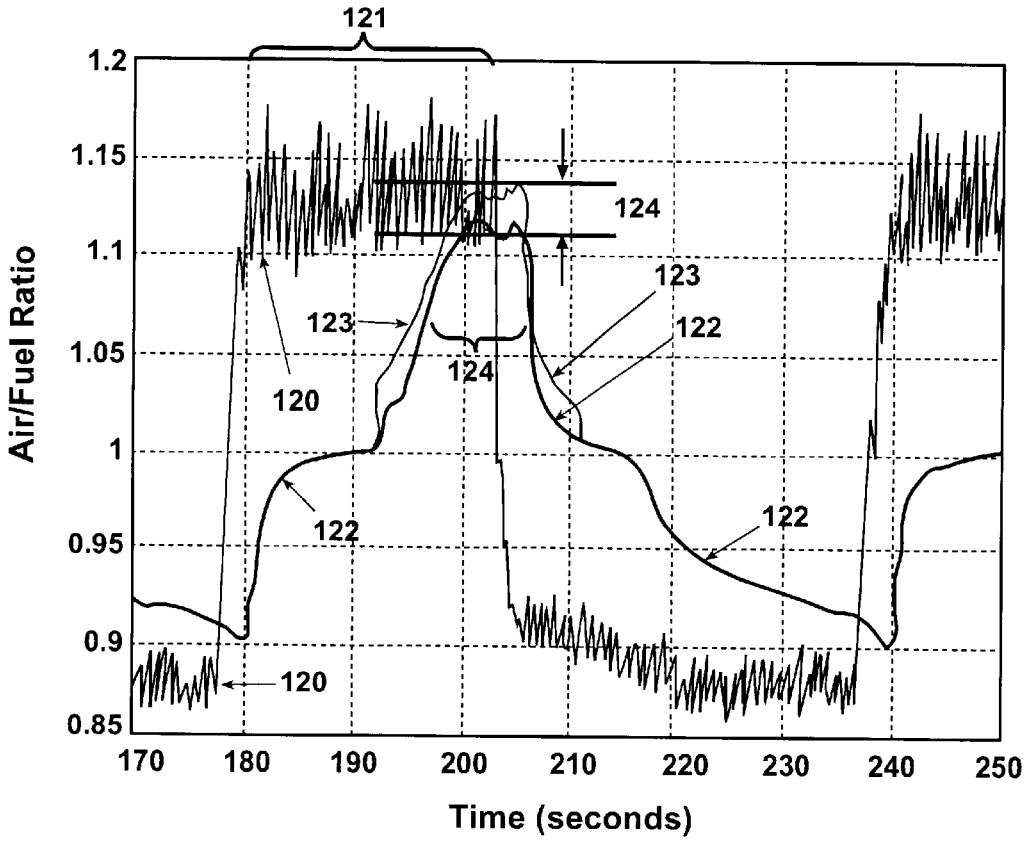
FIG. 2 is a graphical representation of pre-catalyst and post-catalyst air/fuel ratio measurements taken over time during a period of lean engine operation, including an illustration of a corrected post-catalyst sensor measurement, according to a first preferred method of the invention.

Referring now to FIG. 2, the first preferred embodiment of the invention will be described in relationship to illustrative pre-catalyst and post-catalyst output data. As shown in FIG. 2, reference numeral 120 refers to illustrative air/fuel ratio data received from pre-catalyst UEGO sensor 16. Reference numeral 122 refers to illustrative air/fuel ratio data received from post-catalyst UEGO sensor 24. Reference numeral 123 refers to the corrected output of the post-catalyst UEGO sensor 24, according to the first preferred embodiment of the invention. During a period of steady-state lean operation of the engine, shown at reference numeral 121 (between about 180 and 205 seconds on the horizontal axis), the output of pre-catalyst UEGO sensor 16 oscillates between approximately 1.10 and 1.17. However, after reaching steady-state lean operation (at about 200 seconds), the output of the post-catalyst UEGO sensor 24 hovers between 1.11 and 1.13, as shown at reference numeral 124. Thus, the steady-state output of the post-catalyst UEGO sensor 24 indicates a less lean mixture than that which is indicated by the pre-catalyst UEGO sensor 16. This difference is shown at reference numeral 124.

To calculate a lean correction bias, controller 12 calculates the average steady-state air/fuel ratio measured by the pre-catalyst UEGO sensor 16. In FIG. 2, the average steady-state pre-catalyst air/fuel ratio is approximately 1.13. The controller also calculates the average steady-state output of the post-catalyst UEGO sensor 24, which, in FIG. 2, is approximately 1.11. The controller 12 calculates the lean correction bias by taking the difference of the respective steady-state averages. In FIG. 2, the lean correction bias is 0.02. Therefore, during a subsequent period of lean engine operation, the calculated lean correction bias (0.02) is added to the output of the post-catalyst UEGO sensor 24 to adjust the output toward a more lean indication. Further, the calculated lean correction bias is used throughout the entire subsequent period of lean engine operation. As a result, unlike the second preferred embodiment of the invention (described hereinafter), the output of the post-catalyst UEGO sensor 24 is adjusted by a constant correction bias throughout each period of lean air/fuel operation.

It will be appreciated that the values for the measurement of air/fuel ratio stated hereinabove are for illustrative purposes only and that the invention can be practiced with any desired values. It will also be appreciated that the above-described method can be used to calculate rich correction biases during periods of rich engine operation to be used to correct for the water gas shift reaction during subsequent periods of rich operation.

A second preferred method of the invention will now be described. Like in the first preferred method, correction biases are calculated by controller 12 to adjust the output of post-catalyst UEGO sensor 24. In the second preferred method, though, the controller 12 calculates the correction biases according to a pre-determined and pre-programmed correction bias function. The correction bias function returns correction biases based upon the output signal UEGO provided by the post-catalyst proportional UEGO sensor 24. The correction bias function may be implemented through a variety of techniques, including a pre-determined formula, a look-up table, or a map profile of correction biases, as is well-known in the art. Furthermore, the correction bias function may be non-linear, which allows for varying correction biases during the same steady-state engine operation period. The correction bias function is empirically-determined prior to manufacturing from experimental steady-state pre-catalyst and post-catalyst air/fuel measurements.

Figure 3:
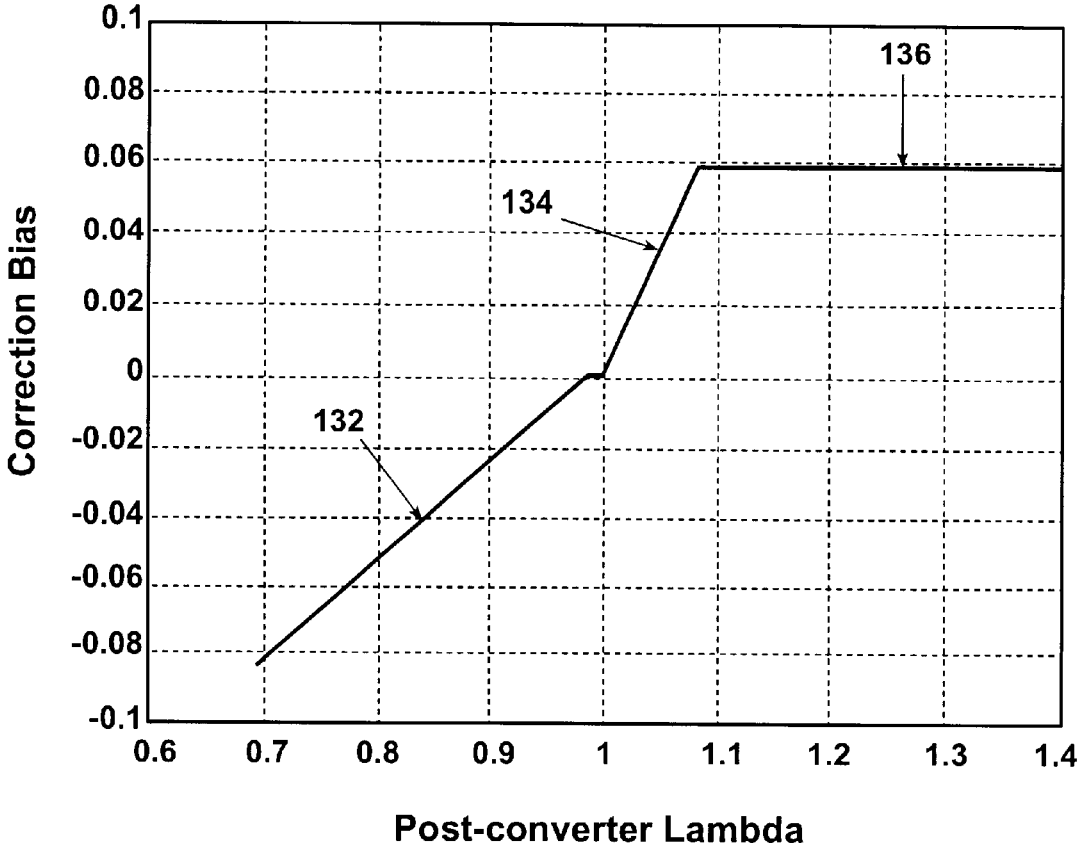
FIG. 3 is a graphical representation of an illustrative non-linear correction function for deriving correction biases for the post-catalyst sensor, according to a second preferred method of the invention.
Figure 4:
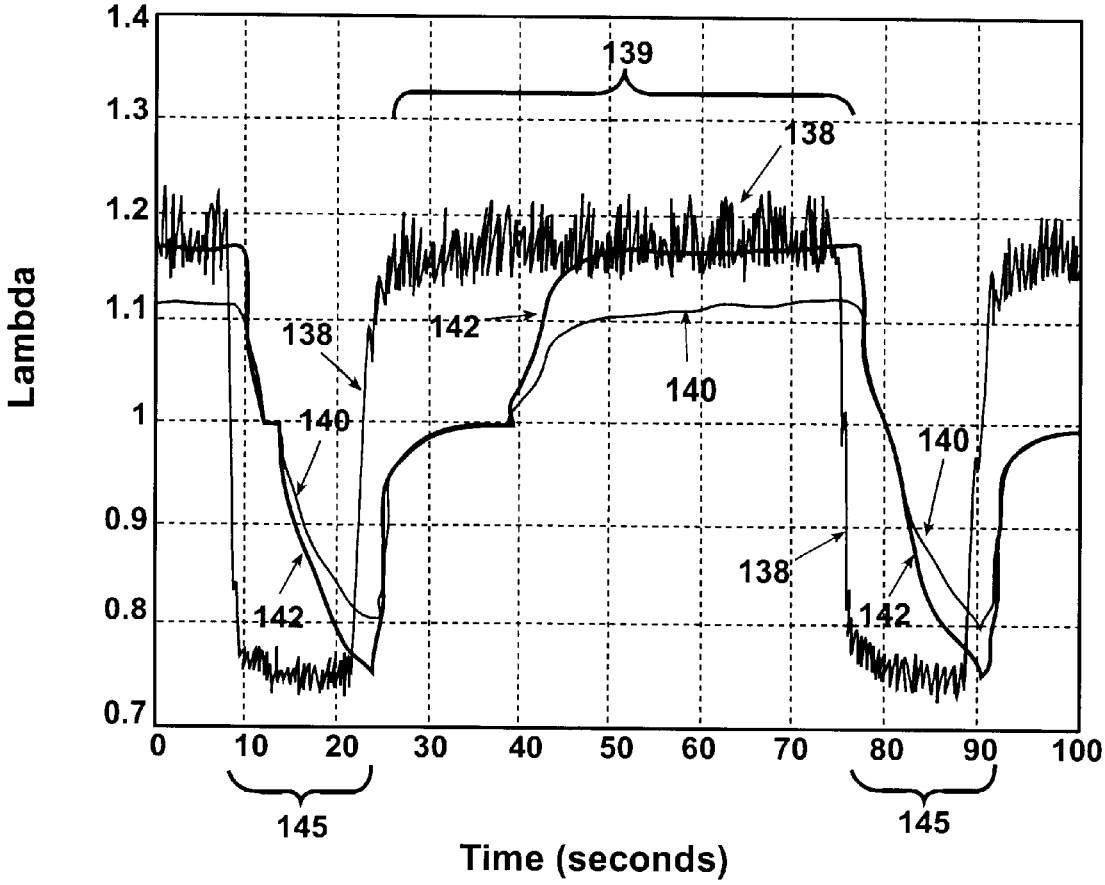
FIG. 4 is a graphical representation of pre-catalyst and post-catalyst air/fuel ratio measurements taken over time during a period of lean engine operation, including an illustrative corrected post-catalyst sensor measurement, according to a second preferred method of the invention.

Referring now to FIGS. 3 and 4, the second preferred method of the invention will be described with respect to illustrative data. Shown in FIG. 3, an illustrative non-linear correction bias function may comprise three linear segments 132, 134 and 136, each segment having a different slope. Correction biases associated with segment 132 (−0.08 to 0.0) apply to output signals received from post-catalyst UEGO sensor 24 during rich operation of engine 10. Correction biases associated with segments 134 and 136 adjust the output signals received from post-catalyst UEGO sensor 24 during lean operation of engine 10. Specifically, when the output signal UEGO falls between 1.0 and about 1.08, the controller 12 applies correction biases that range from 0.0 to 0.06, as shown by segment 134. Similarly, when the output signal UEGO is above about 1.08, the controller 12 applies a constant correction bias of 0.06, as shown by segment 136. As in the first preferred method, the values for the air/fuel ratio measurements and correction biases are for illustrative purposes only, and the invention can be practiced with any desired values.

An illustrative example of the second preferred method of the present invention is shown in FIG. 4. Reference numeral 138 refers to the air/fuel ratio measurements of pre-catalyst UEGO sensor 16. Reference numeral 140 refers to the non-corrected air/fuel ratio measurements (signal UEGO) of post-catalyst UEGO sensor 24. Reference numeral 142 refers to the corrected post-catalyst air/fuel ratio signal, as determined by controller 12. As can be seen in FIG. 4, the second preferred method results in the corrected measurement of the post-catalyst air/fuel ratio being more lean during lean operation (at number 139) and substantially the same as the steady-state air/fuel ratio measured by the pre-catalyst UEGO sensor 16. Similarly, the corrected post-catalyst air/fuel ratio is more rich during rich operation of the engine, as shown at reference numeral 145. Furthermore, it is evident that the magnitude of the correction bias gradually increases from the time it is first applied (at approximately 40 seconds for lean operation) until it levels off at a constant value (at approximately 45 seconds for lean operation). The magnitude of the adjustment is a function of the measured post-catalyst air/fuel ratio. As can be seen in FIG. 4, the corrected measurement of the steady-state post-catalyst air/fuel ratio is approximately equal to the measurement of the steady-state pre-catalyst air/fuel ratio during both lean and rich operation of engine 10.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. In an internal combustion engine, a method of adjusting an air/fuel ratio measurement, comprising the steps of:

determining a first air/fuel ratio upstream of a catalytic converter;

measuring a second air/fuel ratio from a post-catalyst exhaust oxygen sensor positioned downstream of the catalytic converter; and adjusting the second air/fuel ratio measurement by a correction bias toward one of a leaner air/fuel ratio when the post-catalyst sensor indicates a lean air/fuel ratio, and a richer air/fuel ratio when the post-catalyst sensor indicates a rich air/fuel ratio.

2. The method of claim 1, wherein said first air/fuel ratio is determined based upon an air/fuel measurement from a pre-catalyst exhaust oxygen sensor positioned upstream of the catalytic converter.

3. The method of claim 1, wherein said first air/fuel ratio is determined based upon a commanded air/fuel ratio provided to the engine.

4. The method according to claim 1, wherein the correction bias is based on a mathematical difference between the first and second air/fuel ratios.

5. The method according to claim 4, wherein the correction bias is a constant value for a given period of lean engine operation.

6. The method according to claim 4, wherein the correction bias is determined based upon the respective first and second air/fuel ratios during a period of steady-state lean engine operation.

7. The method according to claim 1, wherein the correction bias is determined based on a function of the second air/fuel ratio.

8. The method according to claim 7, wherein the function is non-linear.

9. The method according to claim 7, wherein the correction bias is applied to the second air/fuel ratio measurement both when the second sensor indicates a lean air/fuel ratio and when the second sensor indicates a rich air/fuel ratio.

10. An air/fuel control method for an engine responsive to first and second exhaust gas oxygen sensors respectively positioned upstream and downstream of a catalytic converter, comprising the steps of:

generating a first output signal from the first exhaust gas oxygen sensor indicative of a first air/fuel ratio of the engine;

generating a second output signal from the second exhaust gas oxygen sensor indicative of a second air/fuel ratio of the engine; and generating a correction bias for adjusting the second output signal toward one of a leaner air/fuel ratio when the output signal from the second sensor indicates a lean air/fuel ratio, and a richer air/fuel ratio when the second output signal indicates a rich air/fuel ratio.

11. The method according to claim 10, wherein the correction bias is based on a mathematical difference between the output signal of the first sensor and the output signal of the second sensor.

12. The method according to claim 10, wherein the correction bias is determined based upon the respective air/fuel measurements of the first sensor and the second sensor during a period of steady-state lean engine operation.

13. The method according to claim 10, wherein the correction bias is based upon a function of the second output signal.

14. The method according to claim 13, wherein the function is non-linear.

15. The method according to claim 13, wherein the function generates the correction bias both when the second sensor indicates a lean air/fuel ratio and when the second sensor indicates a rich air/fuel ratio.

16. The method according to claim 12, wherein the correction bias determined during the period of steady-state lean engine operation is used to adjust the air/fuel measurement of the second sensor during a subsequent period of lean engine operation.

17. An exhaust system coupled to an internal combustion engine, comprising:

a catalyst coupled to the engine;

a post-catalyst exhaust oxygen sensor positioned downstream of the catalyst for providing a post-catalyst air/fuel ratio signal; and a controller responsive to said post-catalyst air/fuel ratio signal for calculating a correction bias that adjusts the post-catalyst air/fuel ratio signal more lean when the post-catalyst air/fuel ratio signal is lean and that adjusts the post-catalyst air/fuel ratio signal more rich when the post-catalyst air/fuel ratio signal is rich.

18. The system of claim 17, wherein the controller calculates the correction bias based upon a difference between a pre-catalyst air/fuel ratio and a post-catalyst air/fuel ratio taken when the engine is provided with a lean air/fuel mixture.

19. The system of claim 18, further comprising a pre-catalyst exhaust oxygen sensor positioned between the engine and the catalyst for providing a pre-catalyst air/fuel ratio signal to said controller; and wherein said pre-catalyst air/fuel ratio is determined based upon said pre-catalyst air/fuel ratio signal and said post-catalyst air/fuel ratio is determined based upon said post-catalyst air/fuel ratio signal.

20. The system of claim 17, wherein the controller calculates the correction bias based upon a function of the post-catalyst air/fuel ratio signal.

21. The system of claim 20, wherein the function is non-linear.

22. A method for determining water gas shift reaction effect in a reaction device disposed in an exhaust of an engine comprising determining a mathematical difference between an air/fuel ratio upstream of the device and an air/fuel ratio measured downstream of the device, and wherein the reaction device is a lean $NO_x$ trap.

* * * * *